US011053907B2

(12) United States Patent
Suzuki

(10) Patent No.: US 11,053,907 B2
(45) Date of Patent: Jul. 6, 2021

(54) ENGINE STARTER AND ENGINE STARTING METHOD

(71) Applicant: TOYOTA JIDOSHA KABUSHIKI KAISHA, Toyota (JP)

(72) Inventor: Takeaki Suzuki, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/591,700

(22) Filed: Oct. 3, 2019

(65) Prior Publication Data

US 2020/0109690 A1 Apr. 9, 2020

(30) Foreign Application Priority Data

Oct. 4, 2018 (JP) ..... JP2018-189153

(51) Int. Cl.
*F02N 11/08* (2006.01)
*F02D 29/02* (2006.01)

(52) U.S. Cl.
CPC ..... *F02N 11/0866* (2013.01); *F02N 11/0803* (2013.01); *F02N 11/087* (2013.01); *F02D 29/02* (2013.01); *F02N 2011/0874* (2013.01)

(58) Field of Classification Search
CPC .. Y02T 10/70; F02N 11/0866; F02N 11/0803; F02N 11/087; F02N 2011/0874; F02N 11/0885; F02D 29/02
See application file for complete search history.

(56) References Cited

U.S. PATENT DOCUMENTS 10,060,096 B2 * 8/2018 Takeo ..... B60L 58/13
2002/0167297 A1 * 11/2002 Nozu ..... F02N 11/0862 320/166
2009/0206660 A1 * 8/2009 Makita ..... H02J 7/1423 307/9.1
2013/0119923 A1 * 5/2013 Wright ..... H02J 7/007 320/107
2016/0082943 A1 * 3/2016 Kodawara ..... B60L 7/14 701/22
2016/0089981 A1 * 3/2016 Kodawara ..... B60L 50/16 307/10.1
2016/0244009 A1 8/2016 Demmerle
2018/0056902 A1 * 3/2018 Trinkner ..... B23K 9/1006

FOREIGN PATENT DOCUMENTS

CN 104763547 A 7/2015
CN 105790364 A 7/2016
CN 105905054 A 8/2016
DE 197 09 298 C2 3/1999
DE 602 21 067 T2 3/2008
EP 1 257 036 A2 11/2002
JP 2015-063933 A 4/2015

* cited by examiner

*Primary Examiner* — Gonzalo Laguarda
(74) *Attorney, Agent, or Firm* — Sughrue Mion, PLLC

(57) ABSTRACT

After the vehicle is parked, when the SOC of the auxiliary battery becomes equal to or less than a threshold A, the ECU turns off the switch; when it is predicted that the engine will be started for the first time, the ECU turns on the switch; when the capacitor temperature is equal to or lower than a threshold B, the ECU turns on the heater and starts to charge the capacitor; when the engine is startable and when an engine start operation is performed by the user, the ECU supplies the electric power in the capacitor to the engine starter.

7 Claims, 4 Drawing Sheets

ENGINE STARTER AND ENGINE STARTING METHOD

This non-provisional application is based on Japanese Patent Application No. 2018-189153 filed on Oct. 4, 2018 with the Japan Patent Office, the entire contents of which are hereby incorporated by reference.

BACKGROUND

Field

The present disclosure relates to the control of an engine starter.

Description of the Background Art

Conventionally, when a request to start an engine is received, electric power is supplied to a starter motor to actuate the starter motor, and the starter motor rotates the output shaft of the engine so as to start the engine. Since a relatively large current is required to actuate the starter motor, if the start operation is performed frequently, the battery may be quickly deteriorated.

In order to solve such a problem, for example, Japanese Patent Laying-Open No. 2015-063933 discloses such a technique that when it is predicted that an engine will be started for the first time, the electric power in the battery is used to charge the capacitor, and the electric power charged in the capacitor is supplied to the starter motor so as to start the engine.

SUMMARY

However, when the electric power in the battery which serves as a power supply source to the capacitor is consumed by the other electric devices, the power storage of the battery is lowered, and thereby the capacitor may not be sufficiently charged, which may cause the electric power to be supplied to the starter motor at the time of starting the engine to become insufficient.

An object of the present disclosure is to provide an engine starter which stores the electric power in a capacitor by charging it using the electric power in a battery and supplies the charged power to a starter motor so as to start the engine, and an engine starting method.

An engine starter according to one aspect of the present disclosure includes a starter motor configured to rotate an output shaft of the engine, a capacitor configured to supply the electric power to the starter motor, a battery configured to supply the electric power to the capacitor and other electrical devices, a charger configured to charge the capacitor by using the electric power in the battery, a switch configured to switch a state between the battery and a power consumption device between an electrically connected state and an electrically disconnected state, and a controller configured to control the operation of the switch. When the engine is in a stop state, the controller is configured to control the switch to the electrically disconnected state before an SOC (State Of Charge) of the battery becomes smaller than a first value which corresponds to an amount of electric power required to start the engine.

Thus, when the engine is in the stop state, the battery is disconnected from the power consumption device before the SOC of the battery becomes smaller than the first value, which prevents the electric power in the battery from being consumed by other electric devices when the engine is in the stop state. As a result, the electric power that will be used to charge the capacitor at the time of starting the engine may be preserved in the battery. Therefore, it is possible to prevent the electric power to be supplied to the starter motor at the time of starting the engine from becoming insufficient.

In one embodiment, the controller is configured to control the switch to the electrically connected state so as to charge the capacitor by using the electric power in the battery when it is predicted that the engine will be started, and actuate the starter motor so as to start the engine when a request to start the engine is received from a user.

Thus, when the engine is in the stop state, the battery is electrically disconnected from the power consumption device before the SOC of the battery becomes smaller than the first value, which prevents the electric power in the battery from being consumed by other electric devices until it is predicted that engine 10 will be started. When it is predicted that the engine will be started, the switch is switched to the electrically connected state so as to charge the capacitor, which makes it possible to store in the capacitor an amount of electric power that will be used to start the engine. Therefore, it is possible to prevent the electric power to be supplied to the starter motor at the time of starting the engine from becoming insufficient.

In a further embodiment, the engine starter further includes a heater configured to heat the capacitor, and the controller is configured to actuate the heater so as to heat the capacitor when the temperature of the capacitor becomes lower than a second value.

Thus, when the temperature of the capacitor becomes lower than the second value, the heater is actuated so as to heat the capacitor, which makes it possible to prevent the discharge performance of the capacitor from decreasing in a low temperature environment so as to prevent the engine from being started with difficulty.

A method for starting an engine according to another aspect of the present disclosure is a method for starting an engine by using an engine starter. The engine starter includes a starter motor, a capacitor configured to supply the electric power to the starter motor, a battery configured to supply the electric power to the capacitor and other electric devices, a charger configured to charge the capacitor by using the electric power in the battery, and a switch configured to switch a state between the battery and a power consumption device between an electrically connected state and an electrically disconnected state. The method includes: controlling the switch to the electrically disconnected state before an SOC of the battery becomes smaller than a first value which corresponds to an amount of electric power required to start the engine when the engine is in the stop state; controlling the switch to the electrically connected state so as to charge the capacitor by using the electric power in the battery when it is predicted that the engine will be started; and actuating the starter motor so as to start the engine when a request to start the engine is received from a user after the capacitor is charged.

The foregoing and other objects, features, aspects and advantages of the present disclosure will become more apparent from the following detailed description of the present disclosure when taken in conjunction with the accompanying drawings.

DESCRIPTION OF THE PREFERRED EMBODIMENTS

Figure 1:
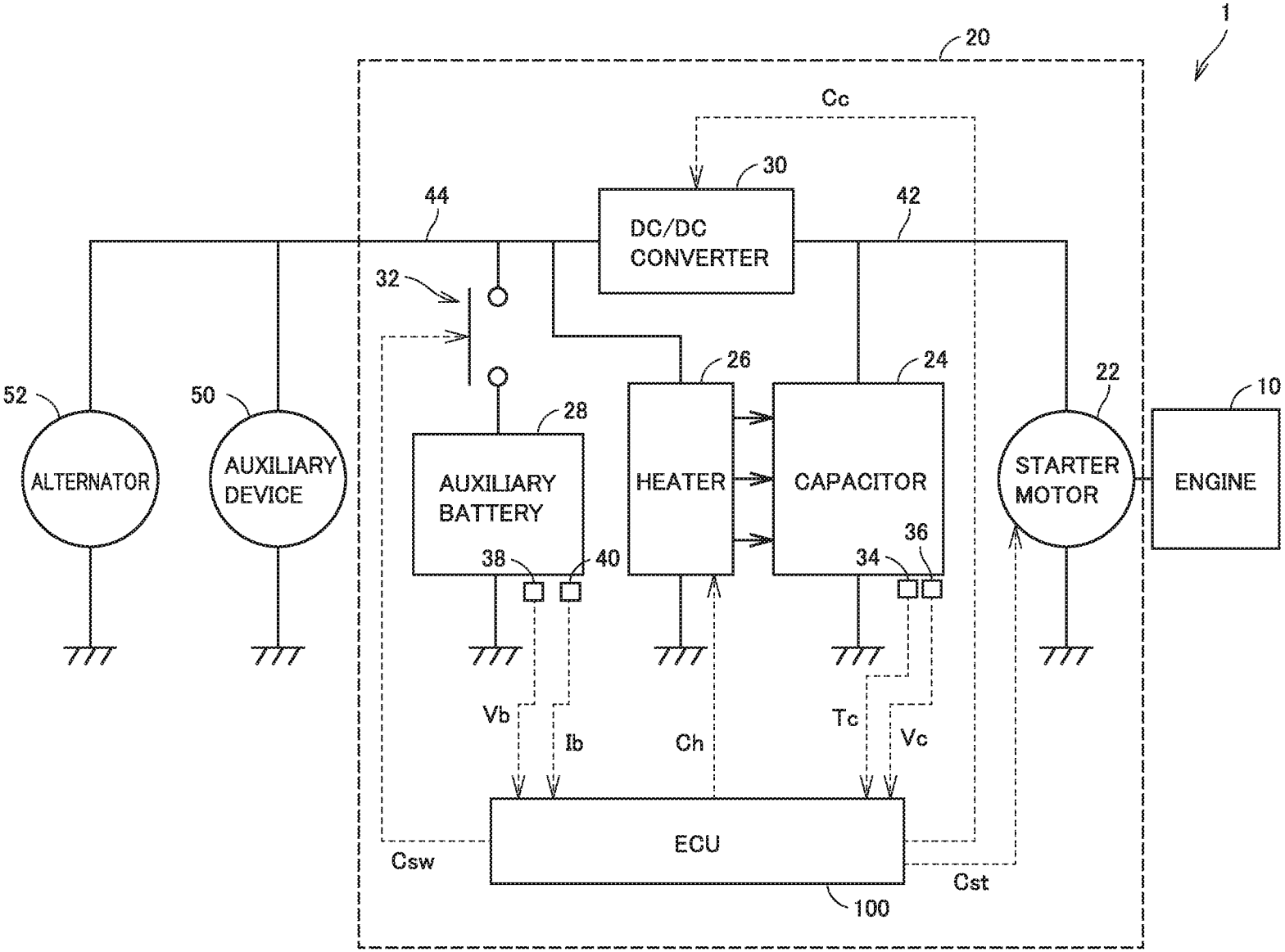
FIG. 1 is a view illustrating an example configuration of a vehicle equipped with an engine starter according to the present embodiment.

Hereinafter, an embodiment of the present disclosure will be described in detail with reference to the drawings. In the drawings, the same or corresponding parts are denoted by the same reference numerals, and the description thereof will not be repeated.

Hereinafter, an example configuration of a vehicle equipped with an engine starter according to the present embodiment will be described. The vehicle may be any vehicle equipped with an engine that can be started by an engine starter which includes a starter motor to be described later, and for example, it may be a vehicle equipped with an engine as a driving source.

FIG. 1 is a view illustrating an example configuration of a vehicle 1 equipped with an engine starter 20 for starting an engine 10 according to the present embodiment. As illustrated in FIG. 1, vehicle 1 includes an engine 10, an engine starter 20, an auxiliary device 50, and an alternator 52. Engine starter 20 includes a starter motor 22, a capacitor 24, a heater 26, an auxiliary battery 28, a DC/DC converter 30, a switch 32, a capacitor temperature sensor 34, a capacitor voltage sensor 36, a battery voltage sensor 38, a current sensor 40, a first power supply line 42, a second power supply line 44, and an ECU (Electronic Control Unit) 100.

Engine 10 is an internal combustion engine such as a gasoline engine or a diesel engine. The configuration of engine 10 is known and will not be described in detail.

Starter motor 22 is configured to rotate an output shaft (crank shaft) of engine 10. Starter motor 22 is actuated by the electric power received via first power supply line 42. The output shaft of engine 10 is installed with a flywheel (not shown) which may be provided with a ring gear, and the ring gear may be formed with a plurality of teeth along the outer periphery thereof. Starter motor 22 includes a motor unit (not shown) configured to rotate a pinion gear, and an actuator configured to move the pinion gear. The actuator is configured to move the pinion gear in the axial direction of the rotation shaft. The motor unit is configured to rotate the pinion gear when receiving an electric power. The actuator and the motor unit operate respectively in response to a control signal Cst from ECU 100.

Starter motor 22 is configured to mesh with the ring gear of the flywheel when the pinion gear is axially moved by the actuator. Therefore, when a request to start engine 10 is received, the pinion gear is axially moved so as to mesh with the ring gear by the actuator according to the control signal from ECU 100, and then the pinion gear is rotated by the motor unit. The rotation of the pinion gear causes the ring gear to rotate and consequently the output shaft of engine 10 to rotate.

Capacitor 24 is configured to supply electric power to starter motor 22 when receiving a request to start engine 10. Capacitor 24 is a power storage device capable of charging/discharging a predetermined amount of electric power in a shorter time than auxiliary battery 28, and it may be an electric double layer capacitor. When it is predicted that engine 10 will be started, capacitor 24 is charged by the electric power received from auxiliary battery 28 via DC/DC converter 30. When receiving a request to start engine 10, capacitor 24 supplies the charged electric power to starter motor 22 via first power supply line 42.

Heater 26 is configured to heat capacitor 24. Heater 26 includes, for example, a resistor circuit and a switch (both not shown) configured to switch second power supply line 44 and the resistor circuit from an electrically connected state and an electrically disconnected state or vice versa. For example, when the switch is switched to the electrically connected state according to a control signal Ch from ECU 100, the electric power is supplied to the resistance circuit via second power supply line 44 so as to cause the resistance circuit to generate heat, and thereby, capacitor 24 is heated by heater 26.

Auxiliary battery 28 is a rechargeable DC power source, and it may be a secondary battery such as a lithium-ion battery, a nickel-metal hydrogen battery or a lead storage battery. Auxiliary battery 28 may supply electric power to at least one of starter motor 22, capacitor 24, heater 26, and/or auxiliary device 50.

Auxiliary device 50 is an electric device other than starter motor 22, capacitor 24, heater 26 and DC/DC converter 30, which uses auxiliary battery 28 as a power supply source. Auxiliary device 50 may include, for example, at least one of a room light mounted inside vehicle 1, a navigation system, an audio system, a clock, a security system, a drive recorder, and another ECU beside ECU 100 which transits to a standby mode (power saving mode) when the vehicle is parked.

Alternator 52 is a generator configured to generate electric power by using the motive power from engine 10 when engine 10 is in operation. Alternator 52 is connected, for example, to the output shaft of engine 10 via an auxiliary belt (not shown) or the like. Thus, when the output shaft of engine 10 rotates, the rotor of alternator 52 rotates accordingly to generate electric power.

The electric power generated by alternator 52 is supplied to auxiliary battery 28 and/or auxiliary device 50 via second power supply line 44.

One end of first power supply line 42 is connected to DC/DC converter 30, and the other end of first power supply line 42 is connected to starter motor 22. First power supply line 42 is branched in the midway, and the branched power supply line is connected to capacitor 24.

One end of second power supply line 44 is connected to DC/DC converter 30, and the other end of second power supply line 44 is connected to alternator 52. Second power supply line 44 is branched in the midway into a plurality of power supply lines, and the branched power supply lines are connected to heater 26, auxiliary battery 28 and auxiliary device 50, respectively.

DC/DC converter 30 is a charger configured to charge capacitor 24 by using the electric power in auxiliary battery 28. DC/DC converter 30 adjusts the voltage of auxiliary battery 28 to a voltage suitable for charging capacitor 24, and supplies the electric power in auxiliary battery 28 to capacitor 24. DC/DC converter 30 operates in response to a control signal Cc from ECU 100.

Switch 32 is provided on a power supply line branched from second power supply line 44 before auxiliary battery 28. Switch 32 is configured to switch auxiliary battery 28 and second power supply line 44 between an electrically connected state and an electrically disconnected state in response to a control signal Csw from ECU 100.

ECU 100 includes a central processing unit (CPU), a memory, and an input/output buffer (none of which is shown). The memory includes, for example, a read only memory (ROM) and a random access memory (RAM). ECU 100 controls each device so as to maintain vehicle 1 at a desired state based on signals received from the respective sensors and information such as maps and programs stored in the memory. As to be described later, ECU 100 executes a start process to start engine 10 by using engine starter 20, for example.

Capacitor temperature sensor 34 detects a temperature Tc of capacitor 24 (hereinafter referred to as a capacitor temperature). Capacitor temperature sensor 34 sends a signal indicating the detected capacitor temperature Tc to ECU 100.

Capacitor voltage sensor 36 detects a voltage Vc of capacitor 24 (hereinafter referred to as a capacitor voltage). Capacitor voltage sensor 36 sends a signal indicating the detected capacitor voltage Vc to ECU 100.

Battery voltage sensor 38 detects a voltage Vb of auxiliary battery 28 (hereinafter referred to as a battery voltage). Battery voltage sensor 38 sends a signal indicating the detected battery voltage Vb to ECU 100.

Current sensor 40 detects a current Ib input to/output from auxiliary battery 28. Current sensor 40 sends a signal indicating the detected current Ib to ECU 100.

The power storage of auxiliary battery 28 is generally managed by using the SOC represented as a percentage of the current power relative to the fully charged power. ECU 100 is configured to sequentially calculate the SOC of auxiliary battery 28 based on the detection results (battery voltage Vb and current Ib) by battery voltage sensor 38 and current sensor 40. As a method of calculating the SOC, various known methods such as a current value integration (coulomb counting) method or an OCV (open circuit voltage) estimation method may be adopted.

When a request to start engine 10 mounted on vehicle 1 having the above configuration is received, the electric power is supplied to starter motor 22, and starter motor 22 is driven to rotate the output shaft of engine 10 so as to start engine 10. Since a relatively large current is required to drive starter motor 22, if the electric power from auxiliary battery 28 is used to drive starter motor 22 so as to start engine 10 frequently, auxiliary battery 28 may be quickly deteriorated.

Thus, when it is predicted that engine 10 will be started, capacitor 24 is charged in advance by using the electric power in auxiliary battery 28, and when a request to start engine 10 is received, the electric power charged in capacitor 24 is supplied to starter motor 22, preventing auxiliary battery 28 from being deteriorated due to the frequent start of engine 10.

However, when the electric power in auxiliary battery 28 which serves as a power supply source to capacitor 24 is consumed by the other electric devices such as auxiliary device 50, the power storage of auxiliary battery 28 is reduced, and thereby capacitor 24 may not be sufficiently charged, which may cause the electric power to be supplied to starter motor 22 at the time of starting engine 10 to become insufficient.

Therefore, in the present embodiment, when engine 10 is in the stop state, ECU 100 controls switch 32 to the electrically disconnected state before an SOC of auxiliary battery 28 becomes smaller than a first value which corresponds to an amount of electric power required to start engine 10. When it is predicted that engine 10 will be started, ECU 100 controls switch 32 to the electrically connected state so as to charge capacitor 24 by using the electric power in auxiliary battery 28. Thereafter, when a request to start engine 10 is received from a user, ECU 100 actuates starter motor 22 so as to start engine 10.

Thereby, before the SOC of auxiliary battery 28 becomes smaller than the first value described above, auxiliary battery 28 is electrically disconnected from the power consumption device, which prevents the electric power in auxiliary battery 28 from being consumed by auxiliary device 50 until it is predicted that engine 10 will be started. As a result, the electric power which will be used to charge capacitor 24 at the time of starting engine 10 may be preserved in auxiliary battery 28. Therefore, it is possible to prevent the electric power to be supplied to starter motor 22 at the time of starting engine 10 from becoming insufficient.

Figure 2:
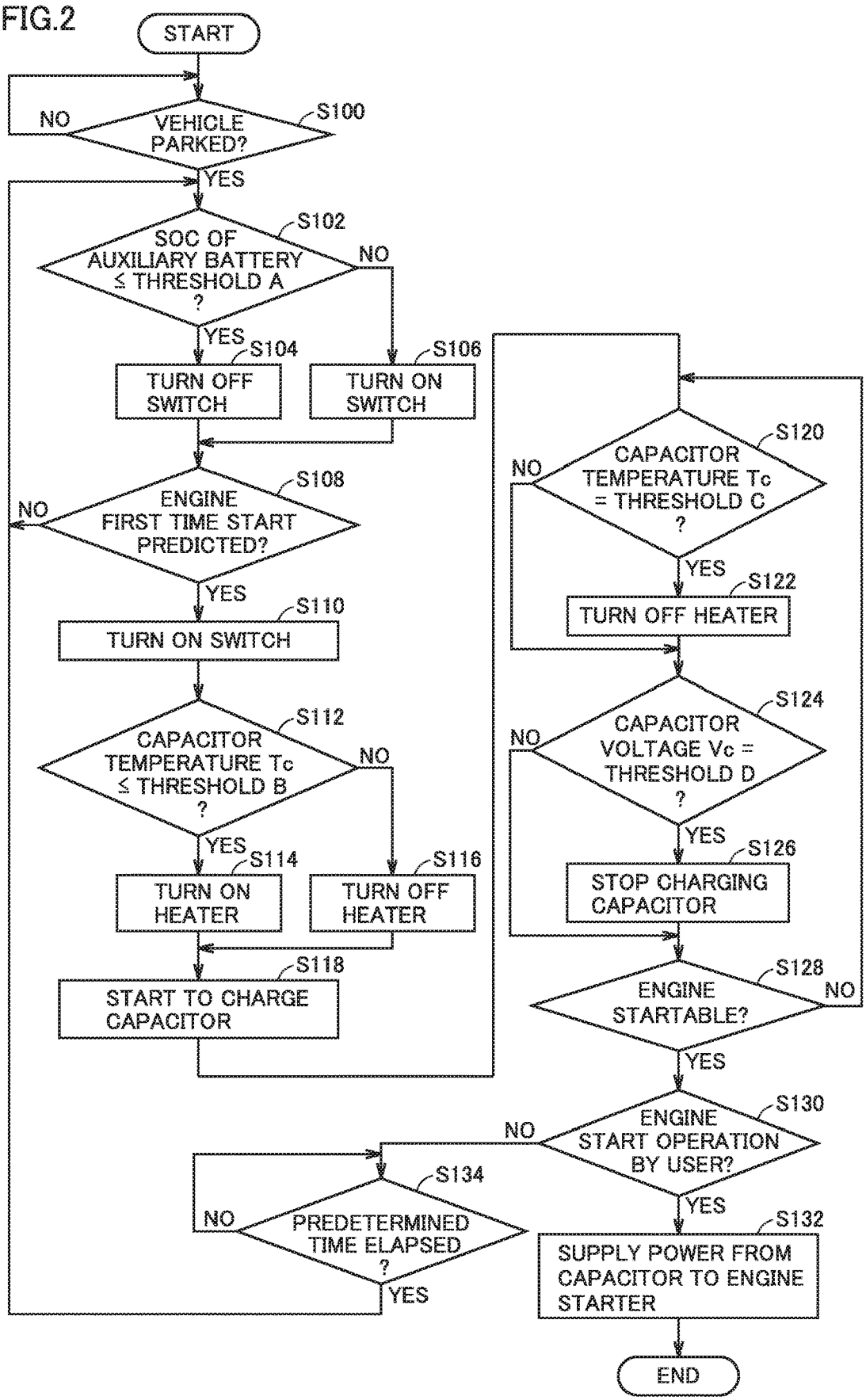
FIG. 2 is a flowchart illustrating an example process to be performed by an ECU.

Hereinafter, a process to be performed by ECU 100 will be described with reference to FIG. 2. FIG. 2 is a flowchart illustrating an example process to be performed by ECU 100. As the initial state of switch 32 and heater 26 while vehicle 1 is parked, switch 32 is in the connected state, and heater 26 is in the stop state. In the following description, the connected state/the disconnected state of switch 32 will be described as the on/off state of switch 32, and the operation state/the stop state of heater 26 will be described as the on/off state of heater 26.

At step 100 (hereinafter, the term of step will be abbreviated as S), ECU 100 determines whether or not vehicle 1 is parked.

For example, ECU 100 may determine that vehicle 1 is parked when the shift lever has been shifted to the parking position and engine 10 is in the stop state. For example, ECU 100 may determine whether the shift lever has been shifted to the parking position by using a shift position sensor (not shown) to detect the position of the shift lever. Furthermore, ECU 100 may determine whether or not engine 10 is in the stop state by using, for example, an IG switch (not shown) that will be turned on when engine 10 is in operation. If it is determined that vehicle 1 is parked (YES at S100), the process proceeds to S102.

At S102, ECU 100 determines whether or not the SOC of auxiliary battery 28 is equal to or less than a threshold A.

In the present embodiment, threshold A is set equal to the sum of an amount of electric power that may be used to actuate starter motor 22 so as to start at least engine 10 (for example, an amount of electric power that may bring the output shaft of engine 10 to a rotational speed or higher for a predetermined period of time so as to start engine 10) and an amount of electric power that may be used to actuate heater 26 so as to raise at least the capacitor temperature to a predetermined temperature. If it is determined that the SOC of auxiliary battery 28 is equal to or less than threshold A (YES at S102), the process proceeds to S104.

At S104, ECU 100 turns off switch 32. On the other hand, if it is determined that the SOC of auxiliary battery 28 is greater than threshold A (NO at S102), the process proceeds to S106.

At S106, ECU 100 turns on switch 32. If switch 32 is in the on state immediately before S106, switch 32 is maintained in the on state.

At S108, ECU 100 determines whether or not it is predicted that engine 10 will be started for the first time.

Specifically, ECU 100 determines whether or not it is predicted that engine 10 will be started for the first time based on a flag (prediction flag) that will be turned on when the first time start of engine 10 is predicted. The first time start means that engine 10 is started for the first time after the IG switch is turned on from the off state.

For example, when at least one of a plurality of actions performed by a user before he/she is seated on the driver's seat of vehicle 1 is detected, ECU 100 turns on the prediction flag denoting the first time start of engine 10.

For example, when a door locking mechanism (not shown) disposed in a door of vehicle 1 is brought from a locked state to an unlocked state, ECU 100 may turn on the prediction flag denoting the first time start of engine 10. For example, ECU 100 may determine whether the door lock mechanism is in the locked state or the unlocked state according to a switch which is configured to output an ON signal when the door lock mechanism is in the locked state and stop the output of the ON signal when the door lock mechanism is in the unlocked state.

Alternatively, for example, when a user touches a door knob of vehicle 1 with his/her hand, ECU 100 may turn on the prediction flag denoting the first time start of engine 10. For example, ECU 100 may determine whether or not a user touches the door knob with his/her hand according to a touch sensor which is disposed inside the door knob and configured to output a signal when the user touches the door knob with his/her hand.

Alternatively, for example, when a door of vehicle 1 is brought from the closed state to the open state, ECU 100 may turn on the prediction flag denoting the first time start of engine 10. For example, ECU 100 may detect that the door is brought from the closed state to the open state according to a switch which is disposed in the door and configured to output an ON signal when the door is opened and stop the output of the ON signal when the door is closed.

Alternatively, for example, when the user is seated on the driver's seat of vehicle 1, ECU 100 may turn on the prediction flag denoting the first time start of engine 10. For example, ECU 100 may determine whether or not the user is seated on the driver's seat of vehicle 1 according to a switch or a pressure sensor which is disposed in the driver's seat and configured to output an ON signal when the user is seated on the driver's seat and stop the output of the ON signal when the user leaves the driver's seat.

If it is predicted that engine 10 will be started for the first time (YES at S108), the process proceeds to S110.

At S110, ECU 100 turns on switch 32. If switch 32 is in the on state immediately before S110, switch 32 is maintained in the on state.

At S112, ECU 100 determines whether or not capacitor temperature Tc is equal to or lower than a threshold B. ECU 100 acquires capacitor temperature Tc from capacitor temperature sensor 34. Threshold B is set, for example, equal to a lower temperature limit at which the electric power is supplied to starter motor 22 so as to start engine 10. If it is determined that capacitor temperature Tc is equal to or lower than threshold B (YES at S112), the process proceeds to S114.

At S114, ECU 100 turns on heater 26. On the other hand, if it is determined that capacitor temperature Tc is greater than threshold B (NO at S112), the process proceeds to S116.

At S116, ECU 100 turns off heater 26. If heater 26 is in the off state immediately before S116, heater 26 is maintained in the off state.

At S118, ECU 100 starts to charge capacitor 24. Specifically, ECU 100 starts to charge capacitor 24 by actuating DC/DC converter 30 so as to supply the electric power in auxiliary battery 28 to capacitor 24.

At S120, ECU 100 determines whether or not capacitor temperature Tc is equal to a threshold C (which is greater than threshold B). If it is determined that capacitor temperature Tc is equal to threshold C, the process proceeds to S122. At S122, ECU 100 turns off heater 26. ON the other hand, if it is determined that capacitor temperature Tc is less than threshold C (NO at S120), the process proceeds to S124.

At S124, ECU 100 determines whether or not capacitor voltage Vc is equal to a threshold D. ECU 100 acquires capacitor voltage Vc from capacitor voltage sensor 36. Threshold D is set, for example, equal to a voltage at which the electric power is supplied to starter motor 22 so as to start engine 10. If it is determined that capacitor voltage Vc is equal to threshold D (YES at S124), the process proceeds to S126.

At S126, ECU 100 stops charging capacitor 24. ECU 100 stops the operation of DC/DC converter 30. On the other hand, if it is determined that capacitor voltage Vc is less than threshold D (NO at S124), the process proceeds to S128.

At S128, ECU 100 determines whether or not engine 10 is startable.

Specifically, ECU 100 determines that engine 10 is startable when capacitor temperature Tc is higher than threshold B and capacitor voltage Vc is equal to threshold D. If it is determined that engine 10 is startable (YES at S128), the process proceeds to S130. If it is determined that engine 10 is not startable (NO at S128), the process returns to S120.

At S130, ECU 100 determines whether or not a start operation of engine 10 is performed by the user. For example, ECU 100 determines that a start operation of engine 10 is performed by the user when a start button is pushed while the brake pedal (or the brake pedal and the clutch pedal) is being depressed by the user, or determines that a start operation of engine 10 is performed by the user when the IG switch is turned on. If it is determined that the start operation of engine 10 is performed by the user (YES at S130), the process proceeds to S132.

At S132, ECU 100 actuates starter motor 22 by using the electric power from capacitor 24. Since the detailed description on the actuation of starter motor 22 are given above, it will not be repeated here.

On the other hand, if it is determined that that no start operation of engine 10 is performed by the user (NO at S130), the process proceeds to S134.

At S134, ECU 100 determines whether or not a predetermined time has elapsed since it is determined that no start operation of engine 10 is performed by the user. The predetermined time may be preliminarily set according to experiments or the like. If it is determined that the predetermined time has elapsed (YES at S134), the process returns to S102. On the other hand, if it is determined that the predetermined time has not elapsed (NO at S134), the process returns to S134.

Figure 3:
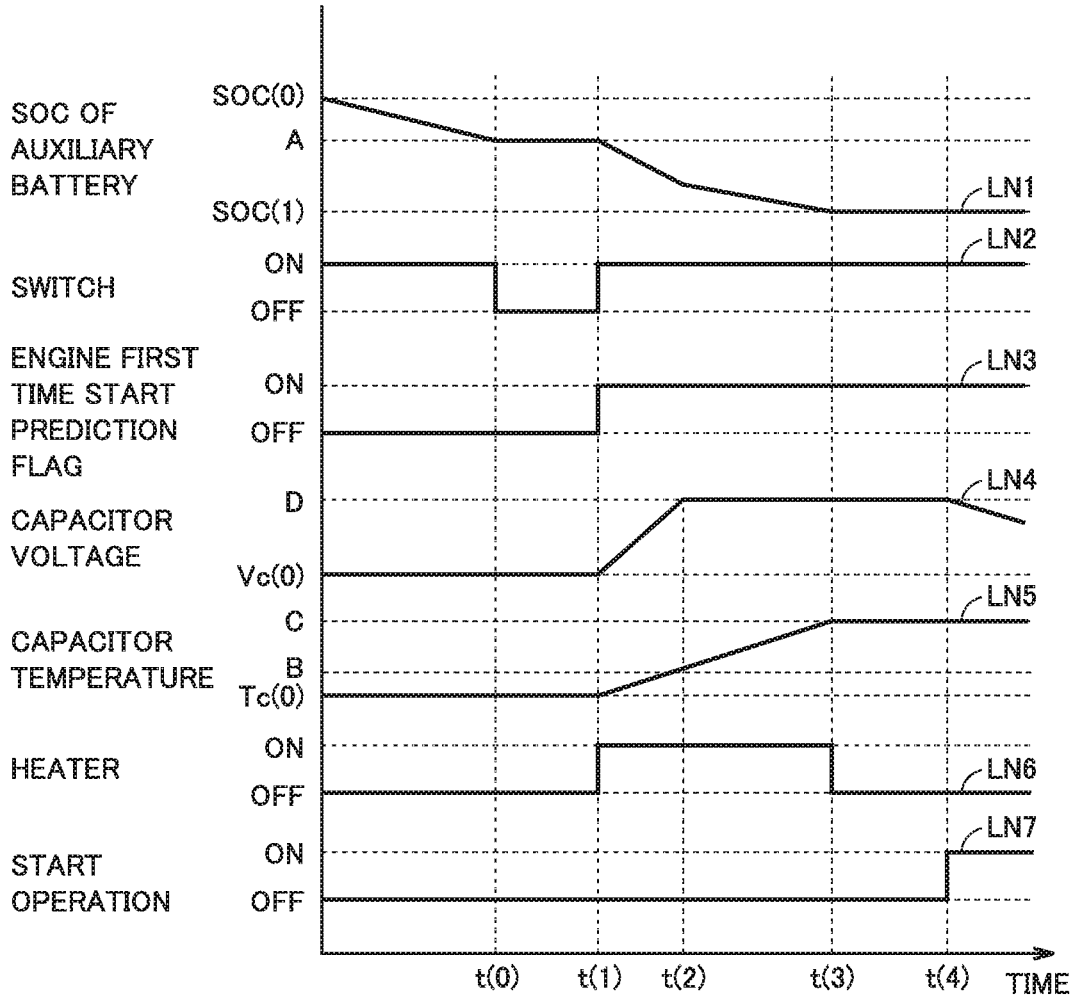
FIG. 3 is a timing chart illustrating example operations to be performed by the ECU.

The operations of ECU 100 based on the above-described structure and the flowchart will be described with reference to FIG. 3. FIG. 3 is a timing chart illustrating example operations to be performed by ECU 100. The vertical axis in FIG. 3 represents the SOC of auxiliary battery 28, the state of switch 32, the state of the prediction flag denoting the first time start of engine 10, capacitor voltage Vc, capacitor temperature Tc, the state of heater 26, and the presence or absence of the start operation, and the horizontal axis of FIG. 3 represents time.

LN1 in FIG. 3 indicates the change on the SOC of auxiliary battery 28. LN2 in FIG. 3 indicates the change on the state of switch 32. LN3 in FIG. 3 indicates the change on the prediction flag denoting the first time start of engine 10. LN4 in FIG. 3 indicates the change on capacitor voltage Vc. LN5 in FIG. 3 indicates the change on capacitor temperature Tc. LN6 in FIG. 3 indicates the change on the operation state of heater 26. LN7 in FIG. 3 indicates the change on the presence or absence of the start operation.

For example, when vehicle 1 is parked, the SOC of auxiliary battery 28 is equal to SOC(0) as illustrated by LN1 in FIG. 3. Further, as illustrated by LN2 in FIG. 3, switch 32 is in the ON state, as illustrated by LN4 in FIG. 3, capacitor voltage Vc is equal to Vc(0) which is a voltage in the uncharged state, and as illustrated by LN6 in FIG. 3, heater 26 is in the off state.

When vehicle 1 is parked (YES at S100), due to a dark current flowing in auxiliary device 50, the SOC of auxiliary battery 28 decreases over time.

At time t(0) when the SOC of auxiliary battery 28 becomes equal to or lower than threshold A (YES at S102), switch 32 is turned off (S104) as illustrated by LN2 in FIG. 3. Therefore, the electric power stored in auxiliary battery 28 is prevented from being consumed by the dark current flowing in auxiliary device 50, and thus, the SOC of auxiliary battery 28 is maintained constant after time t(0) as illustrated by LN1 of FIG. 3.

At time t(1) when the door lock mechanism of vehicle 1 is brought from the locked state to the unlocked state as illustrated by LN3 in FIG. 3, the prediction flag denoting the first time start of engine 10 is turned on. Since the prediction flag is turned on, it is predicted that engine 10 will be started for the first time (YES at S108), switch 32 is turned on (S110) as indicated by LN2 in FIG. 3.

At this time, as indicated by LN5 in FIG. 3, since capacitor temperature Tc is equal to or lower than threshold B (YES at S112), heater 26 is turned on (S114) as indicated by LN6 in FIG. 3.

Since heater 26 is turned on, as illustrated by LN5 in FIG. 3, capacitor temperature Tc rises over time after time t(1).

Since the charging of capacitor 24 is started at time t(1), capacitor voltage Vc increases over time after time t(1) as illustrated by LN4 in FIG. 3. While capacitor 24 is being charged, the SOC of auxiliary battery 28 decreases over time as indicated by LN1 in FIG. 3.

Then, at time t(2), before capacitor temperature Tc reaches threshold C (NO at S120), capacitor voltage Vc becomes equal to threshold D (YES at S124) as illustrated by LN4 in FIG. 3, the charging of capacitor 24 is stopped.

Since the charging of capacitor 24 is stopped after time t(2), the reduction rate of the SOC of auxiliary battery 28 becomes slow.

Then, at time t(3) when capacitor temperature Tc reaches threshold C (YES at S120) as illustrated by LN5 in FIG. 3, heater 26 is turned off (S122), and engine 10 is startable (YES at S128).

Then, at time t(4) when a user performs a start operation by pressing the start button or the like (YES at S130) as illustrated by LN7 in FIG. 3, the electric power is supplied from capacitor 24 to starter motor 22 so as to actuate starter motor 22. As a result, the output shaft of engine 10 is rotated and the start control is performed. The start control includes, for example, at least a fuel injection control and an ignition control (in the case of a gasoline engine).

As described above, according to the engine starter according to the present embodiment, when engine 10 is in the stop state, auxiliary battery 28 is disconnected from the power consumption device before the SOC of auxiliary battery 28 becomes smaller than a value which corresponds to an amount of electric power required to start engine 10, which prevents the electric power in the battery from being consumed by other electric devices until it is predicted that engine 10 will be started. As a result, it is possible to store in auxiliary battery 28 the electric power that will be used to charge capacitor 24 at the time of starting engine 10. Therefore, it is possible to prevent the electric power to be supplied to the starter motor at the time of starting engine 10 from becoming insufficient. Therefore, it is possible to provide an engine starter which stores the electric power in a capacitor by charging it using the electric power in a battery and supplies the charged power to a starter motor so as to start the engine, and an engine starting method.

Furthermore, when capacitor temperature Tc becomes lower than threshold B, heater 26 is actuated so as to heat capacitor 24, which makes it possible to prevent the discharge performance of capacitor 24 from decreasing so as to prevent engine 10 from being started with difficulty in a low temperature environment.

Hereinafter, a modification will be described.

In the above embodiment, it is described that the engine starter of engine 10 includes a heater 26, and when it is predicted that engine 10 will be started for the first time, heater 26 is turned on until capacitor temperature Tc reaches threshold C. However, heater 26 may not be provided, and accordingly, a control process performed on heater 26 according to capacitor temperature Tc may be omitted.

Figure 4:
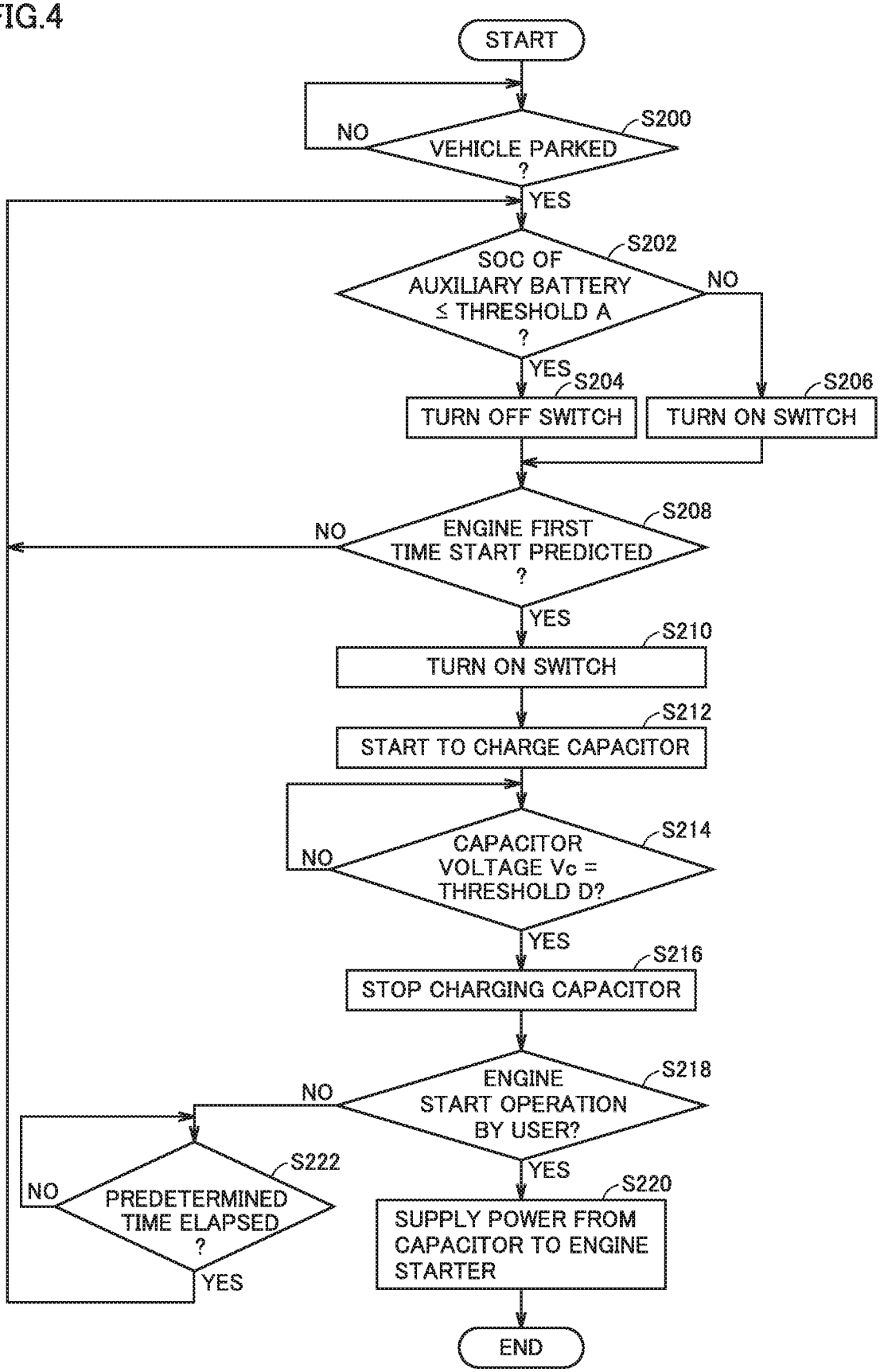
FIG. 4 is a flowchart illustrating an example process to be performed by the ECU according to a modification.

Hereinafter, a control process to be performed by ECU 100 in the present modification will be described with reference to FIG. 4. FIG. 4 is a flowchart illustrating an example process to be performed by the ECU according to the present modification.

The process from S200 to S210 in the flowchart of FIG. 4 is the same as the process from S100 to S110 in the flowchart of FIG. 2 except for the following points. Therefore, the detailed description of the same parts will not be repeated.

Threshold A at S202 is set equal to an amount of electric power that may be used to actuate starter motor 22 so as to start at least engine 10 (for example, an amount of electric power that may bring the output shaft of engine 10 to a rotational speed or higher for a predetermined period of time so as to start engine 10). When switch 32 is turned on at S210, the process proceeds to S212. At S212, ECU 100 starts to charge capacitor 24.

At S214, ECU 100 determines whether or not capacitor voltage Vc is equal to threshold D. Threshold D is the same as threshold D in the process of S124 in FIG. 2 described above, and thereby the detailed description thereof will not be repeated. If it is determined that capacitor voltage Vc is equal to threshold D (YES at S214), the process proceeds to S216.

At S216, ECU 100 stops charging capacitor 24. On the other hand, if it is determined that capacitor voltage Vc is smaller than threshold D (NO at S214), the process returns to S214.

At S218, ECU 100 determines whether or not a start operation of engine 10 is performed by the user. If it is determined that a start operation of engine 10 is performed by the user (YES at S218), the process proceeds to S220.

At S220, ECU 100 actuates starter motor 22 by using the electric power from capacitor 24. On the other hand, if it is determined that no start operation of engine 10 is performed by the user (NO at S218), the process proceeds to S222.

At S222, ECU 100 determines whether or not a predetermined time has elapsed since it is determined that no start operation of engine 10 is performed by the user. If it is determined that the predetermined time has elapsed (YES at S222), the process returns to S202. On the other hand, if it is determined that the predetermined time has not elapsed (NO at S222), the process returns to S222.

Even in this case, when engine 10 is in the stop state, auxiliary battery 28 is disconnected from a power consumption device before the SOC of auxiliary battery 28 becomes smaller than a value which corresponds to an amount of electric power required to start engine 10, which prevents the electric power in the battery from being consumed by other electric devices until it is predicted that engine 10 will be started. As a result, it is possible to store in auxiliary battery 28 the electric power that will be used to charge capacitor 24 at the time of starting engine 10. Therefore, it is possible to prevent the electric power to be supplied to the starter motor at the time of starting engine 10 from becoming insufficient.

In the above-described embodiment, vehicle 1 is described by way of example as a vehicle equipped with only an engine as a driving source, but it may be a hybrid vehicle equipped with an engine started by an engine starter including a starter motor and a motor as a driving source.

In the above-described embodiment, it is described that the electric power is supplied from capacitor 24 to starter motor 22, the electric power may be supplied to starter motor 22 from auxiliary battery 28 and capacitor 24.

In the above-described embodiment, it is described that switch 32 is turned off when the SOC of auxiliary battery 28 becomes equal to or less than threshold A at the time of starting engine 10 for the first time, switch 32 may be turned off when the SOC of auxiliary battery 28 becomes equal to or less than threshold A when the engine is in the idle stop state. In this case, when a condition for bringing the engine from the idle stop state (for example, a condition that the depression of the brake is released or a condition that the idle stop period has elapsed for a predetermined time) is satisfied, it is predicted that engine 10 will be started, and switch 32 is turned on so as to charge capacitor 24.

It should be noted that the embodiment and the modification mentioned above may be implemented separately or in combination appropriately.

Although the present disclosure has been described and illustrated in detail, it is clearly understood that the same is by way of illustration and example only and is not to be taken by way of limitation, the scope of the present disclosure being interpreted by the terms of the appended claims.

What is claimed is:

1. An engine starter for starting an engine, comprising:

a starter motor configured to rotate an output shaft of the engine;

a capacitor configured to supply electric power to the starter motor;

a battery configured to supply electric power to the capacitor and other electrical devices, the other electrical devices comprising at least one circuit and configured to consume power for a purpose other than starting the engine;

a charger comprising at least one circuit, the charger configured to charge the capacitor by using the electric power in the battery;

a switch configured to switch a state between the battery and the other electrical devices between an electrically connected state and an electrically disconnected state;

a heater configured to heat the capacitor; and a controller configured to control the operation of the switch, wherein the controller is configured to:

control the switch to the electrically disconnected state before an SOC of the battery becomes smaller than a first value which corresponds to a sum of an amount of electric power required to start the engine and an amount of electric power to raise the capacitor temperature to a predetermined temperature, when the engine is in a stop state, control the switch to the electrically connected state so as to charge the capacitor by using the electric power in the battery when it is predicted that the engine will be started, and actuate the starter motor so as to start the engine when a request to start the engine is received from a user, and actuate the heater so as to heat the capacitor when the temperature of the capacitor becomes lower than a second value.

2. The engine starter according to claim 1, wherein one of the other electrical devices is one from among a light, a navigation system, an audio system, a clock, a security system, a drive recorder, or an electronic control unit (ECU).

3. The engine starter according to claim 1, wherein the switch is configured to disconnect the battery from the other electrical devices and from an alternator that is configured to supply power to the other electrical devices or the battery.

4. The engine starter according to claim 1, wherein the other electrical devices are devices that are a part of at least one electrical auxiliary system of a vehicle.

5. The engine starter according to claim 1, wherein the switch is configured to disconnect the battery from the other electrical devices and the capacitor.

6. A method for starting an engine by using an engine starter, the engine starter including:

a starter motor;

a capacitor configured to supply electric power to the starter motor;

a battery configured to supply electric power to the capacitor and other electrical devices, the other electrical devices comprising at least one circuit and configured to consume power for a purpose other than starting the engine;

a charger comprising at least one circuit, the charger configured to charge the capacitor by using the electric power in the battery;

a switch configured to switch a state between the battery and the other electrical devices between an electrically connected state and an electrically disconnected state; and a heater configured to heat the capacitor, the method comprising:

controlling the switch to the electrically disconnected state before an SOC of the battery becomes smaller than a first value which corresponds to a sum of an amount of electric power required to start the engine and an amount of electric power to raise the capacitor temperature to a predetermined temperature, when the engine is in a stop state;

controlling the switch to the electrically connected state so as to charge the capacitor by using the electric power in the battery when it is predicted that the engine will be started;

actuating the starter motor so as to start the engine when a request to start the engine is received from a user after the capacitor is charged; and actuating the heater so as to heat the capacitor when the temperature of the capacitor becomes lower than a second value.

7. The method according to claim 6, wherein the switch is configured to disconnect the battery from the other electrical devices and the capacitor.

* * * * *